US006474425B1

(12) United States Patent
Truax et al.

(10) Patent No.: US 6,474,425 B1
(45) Date of Patent: Nov. 5, 2002

(54) ASYMMETRIC DIAMOND IMPREGNATED DRILL BIT

(75) Inventors: David Truax, Houston; Timothy P. Beaton, The Woodlands, both of TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/619,742

(22) Filed: Jul. 19, 2000

(51) Int. Cl.[7] ..... E21B 10/00
(52) U.S. Cl. ..... 175/398; 175/405.1; 175/434
(58) Field of Search ..... 175/398, 399, 175/400, 405.1, 434

(56) References Cited

U.S. PATENT DOCUMENTS 2,953,354 A * 9/1960 Williams, Jr. et al. ..... 255/61
4,234,048 A * 11/1980 Rowley ..... 175/329
4,266,621 A * 5/1981 Brock ..... 175/329
4,274,769 A * 6/1981 Multakh ..... 408/145
5,042,596 A * 8/1991 Brett et al. ..... 175/57
5,388,484 A * 2/1995 Bogner ..... 76/108.2
5,649,603 A * 7/1997 Simpson et al. ..... 175/323
5,810,079 A * 9/1998 Lynde et al. ..... 166/55.6
5,957,223 A * 9/1999 Doster et al. ..... 175/57
5,992,547 A * 11/1999 Caraway et al. ..... 175/385
5,992,548 A * 11/1999 Silva et al. ..... 175/391
6,009,962 A * 1/2000 Beaton ..... 175/426
6,123,160 A * 9/2000 Tibbitts ..... 175/385
6,206,117 B1 * 3/2001 Tibbitts et al. ..... 175/399
6,241,036 B1 * 6/2001 Lovato et al. ..... 175/432

OTHER PUBLICATIONS

Hycalog; 7 in.×61/2 in. 753BC; undated; two pages.*

* cited by examiner

*Primary Examiner*—David Bagnell
*Assistant Examiner*—Jennifer R. Dougherty
(74) *Attorney, Agent, or Firm*—Rosenthal & Osha L.L.P.

(57) ABSTRACT

A drill bit including a bit body and a plurality of blades formed in the bit body. The blades are formed, at least in part, from a base matrix material that on one embodiment is impregnated with abrasive particles. One side of the bit is formed, with respect to its axis of rotation, to a smaller radius than the opposite side of the bit. The asymmetry of the bit enables the bit to drill a larger diameter hole than a pass through diameter of the bit. The opposite side defines a contact angle between the bit and a formation. In one embodiment, the contact angle is at least 140 degrees. In one embodiment, a plurality of inserts may be located on the blades to provide gage protection. In another embodiment, the bit may also include a gage sleeve that helps keep the bit stabilized in the wellbore.

63 Claims, 5 Drawing Sheets

ASYMMETRIC DIAMOND IMPREGNATED DRILL BIT

BACKGROUND OF THE INVENTION

1. Technical Field

The invention relates generally to drag bits made from solid infiltrated matrix material impregnated with abrasive particles. More particularly, the invention relates to impregnated bits adapted to drill a hole larger than the diameter of an opening through which the bit can freely pass.

2. Background Art

Rotary drill bits with no moving elements on them are typically referred to as "drag" bits. Drag bits are often used to drill very hard or abrasive formations, or where high bit rotation speeds are required.

Drag bits are typically made from a solid body of matrix material formed by a powder metallurgy process. The process of manufacturing such bits is known in the art. During manufacture, the bits are fitted with different types of cutting elements that are designed to penetrate the formation during drilling operations. One example of such a bit includes a plurality of polycrystalline diamond compact ("PDC") cutting elements arranged on the bit body to drill a hole. Another example of such bits uses much smaller cutting elements. The small cutting elements may include natural or synthetic diamonds that are embedded in the surface of the matrix body of the drill bit. Bits with surface set diamond cutting elements are especially well suited for hard formations which would quickly wear down or break off PDC cutters.

However, surface set cutting elements also present a disadvantage because, once the cutting elements are worn or sheared from the matrix, the bit has to be replaced because of decreased performance, including decreased rate of penetration ("ROP").

An improvement over surface set cutting elements is provided by diamond impregnated drill bits. Diamond impregnated bits are also typically manufactured through a powder metallurgy process. During the powder metallurgy process, abrasive particles are arranged within a mold to infiltrate the base matrix material. Upon cooling, the bit body includes the matrix material and the abrasive particles suspended both near and on the surface of the drill bit. The abrasive particles typically include small particles of natural or synthetic diamond. Synthetic diamond used in diamond impregnated drill bits is typically in the form of single crystals. However, thermally stable polycrystalline diamond ("TSP") particles may also be used.

Diamond impregnated drill bits are particularly well suited for drilling very hard and abrasive formations. The presence of abrasive particles both at and below the surface of the matrix body material ensures that the bit will substantially maintain its ability to drill a hole even after the surface particles are worn down, unlike bits with surface set cutting elements.

In many drilling environments, it can become difficult to remove the drill bit from the wellbore after a particular portion of the wellbore is drilled. Such environments include, among others, drilling through earth formations which swell or move, and wellbores drilled along tortuous trajectories. In many cases when drilling in such environments, the bit can be come stuck when the wellbore operator tries to remove it from the wellbore. One method known in the art to reduce such sticking is to include a reaming tool in the drilling assembly above the drill bit, or to use a reaming tool in a separate reaming operation after the initial drilling by the drill bit. The use of reamers or other devices to ream the wellbore can incur substantial cost if the bottom hole assembly must be tripped in and out of the hole several times to complete the procedure.

Another, more cost effective method to drill wellbores in such environments is to use a special type of bit which has an effective external diameter (called "pass through" diameter, meaning the diameter of an opening through which such a bit will freely pass) which is smaller than the diameter of hole which the bit drills when rotating. For example, a bit sold under model number 753BC by Hycalog, Houston, Tex., is a "bi-center" bit with surface set diamonds. This bit drills a hole having a larger diameter (called the "drill diameter") than the pass-through diameter of the bit. Another type of bit is shown in U.S. Pat. No. 2,953,354 issued to Williams et al., which discloses an asymmetric bit having surface set cutters. The structure of a bit such as the one described in the Williams '354 patent is shown in prior art FIGS. 1 and 2. This bit has an asymmetric bit body. A limitation to bits having surface set cutters is that the cutters are subject to "popping out" of the blades into which they are set. Such bits lose drilling effectiveness when the cutting elements pop out of the blades, as previously explained. Another limitation to the foregoing bits is that they are not well protected against wear in the "gage" area of the bit. If the gage area is subject to wear, the bit will drill an undersize wellbore, possibly requiring expensive reaming operations to obtain the full expected drill diameter.

Other prior art bits, such as the bit shown in U.S. Pat. No. 4,266,621 issued to Brock, for example, are eccentric because the axis of the bit body is offset from the axis of rotation. Another way to make an eccentric bit is to radially offset the threaded connection used to connect the drill bit to the bottom hole or drilling assembly. Such bits tend to be dynamically unstable, particularly when drilling a wellbore along a particular selected trajectory, such as when directional drilling, precisely because they are eccentric about the axis of rotation of the drill string.

Generally speaking, the prior art bits are deficient in their ability to withstand a high wear environment in the face area and/or gage area. Accordingly, there is a need for a drill bit which can drill a borehole having a diameter larger than its pass through diameter, which is stable during directional drilling operations, and which is well protected against premature wear on the face of the bit. Additionally, there is a need for a drill bit which can drill a borehole larger than its pass through diameter, which is stable during directional drilling and which is well protected against premature wear in the gage area of the bit to maintain drill diameter.

SUMMARY OF THE INVENTION

One aspect of the invention is a drill bit including a bit body and a plurality of blades formed in the bit body at least in part from solid infiltrated matrix material. The blades are impregnated with a plurality of abrasive particles. With respect to an axis of rotation of the bit, one side of the bit body is formed to a smaller radius than an opposite side, so that the bit drills a larger diameter hole than a pass through diameter of the bit.

Another aspect of the invention is a drill bit including a bit body, and a plurality of blades formed in the bit body at least in part from solid infiltrated matrix material. The blades have abrasive cutters thereon. The blades are formed so that, with respect to an axis of rotation of the bit, one side of the bit body is formed to a smaller radius than an opposite side of the bit so that the bit drills a larger diameter hole than a pass through diameter of the bit. The bit further includes a gage sleeve attached to the bit body at a connection end of the bit body.

Another aspect of the invention is a drill bit comprising a bit body, and a plurality of blades formed in the bit body at least in part from solid infiltrated matrix material. The blades have abrasive cutters thereon. The blades are formed so that, with respect to an axis of rotation of the bit, one side of the bit body is formed to a smaller radius than an opposite side of the bit so that the bit drills a larger diameter hole than a pass through diameter of the bit. The blades on at least the opposite side comprise an extended axial length where the blades are formed to the respective one of the radii. In one embodiment, the extended axial length is at least 60 percent of a drill diameter of the bit.

Another aspect of the invention is a drill bit including a bit body, and a plurality of blades formed in the bit body at least in part from solid infiltrated matrix material. The blades have abrasive cutters thereon. The blades are formed so that, with respect to an axis of rotation of the bit, one side of the bit body is formed to a smaller radius than an opposite side of the bit so that the bit drills a larger diameter hole than a pass through diameter of the bit. The blades on the opposite side define a contact angle of at least 140 degrees.

Other aspects and advantages of the invention will be apparent from the following description and the appended claims.

DETAILED DESCRIPTION

Figure 1:
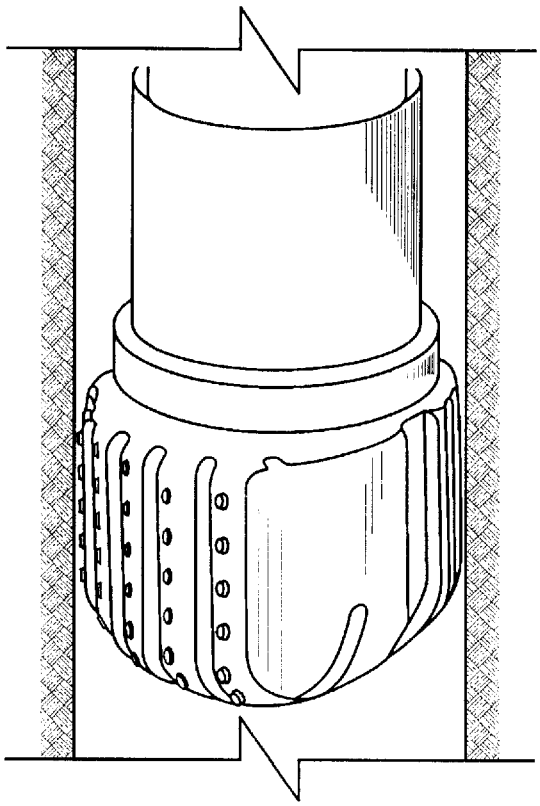
FIG. 1 (Prior Art)
FIG. 1 shows a perspective view of a prior art drill bit.
Figure 2:
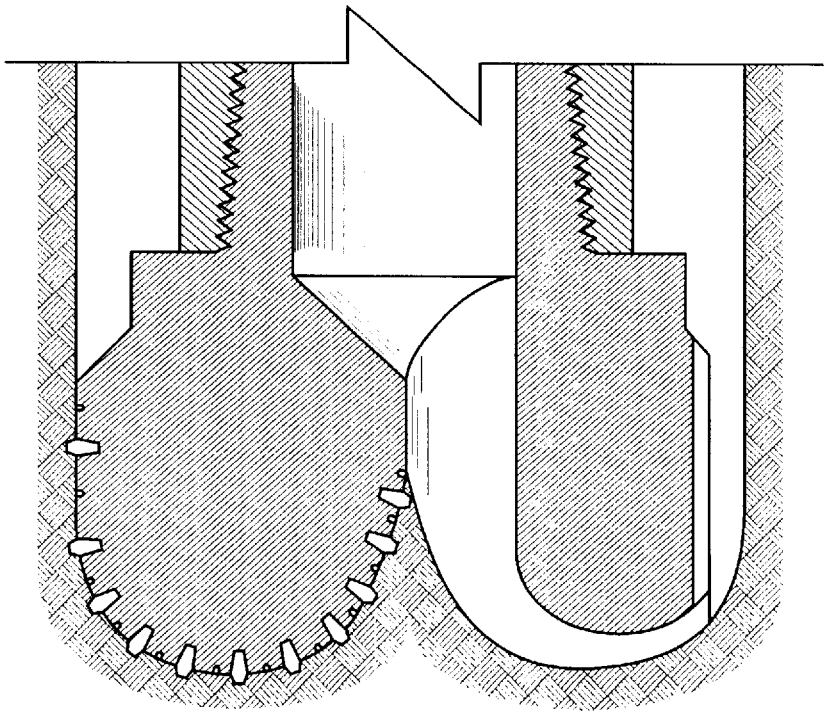
FIG. 2 (Prior Art)
FIG. 2 shows a side view of a prior art drill bit.
Figure 3:
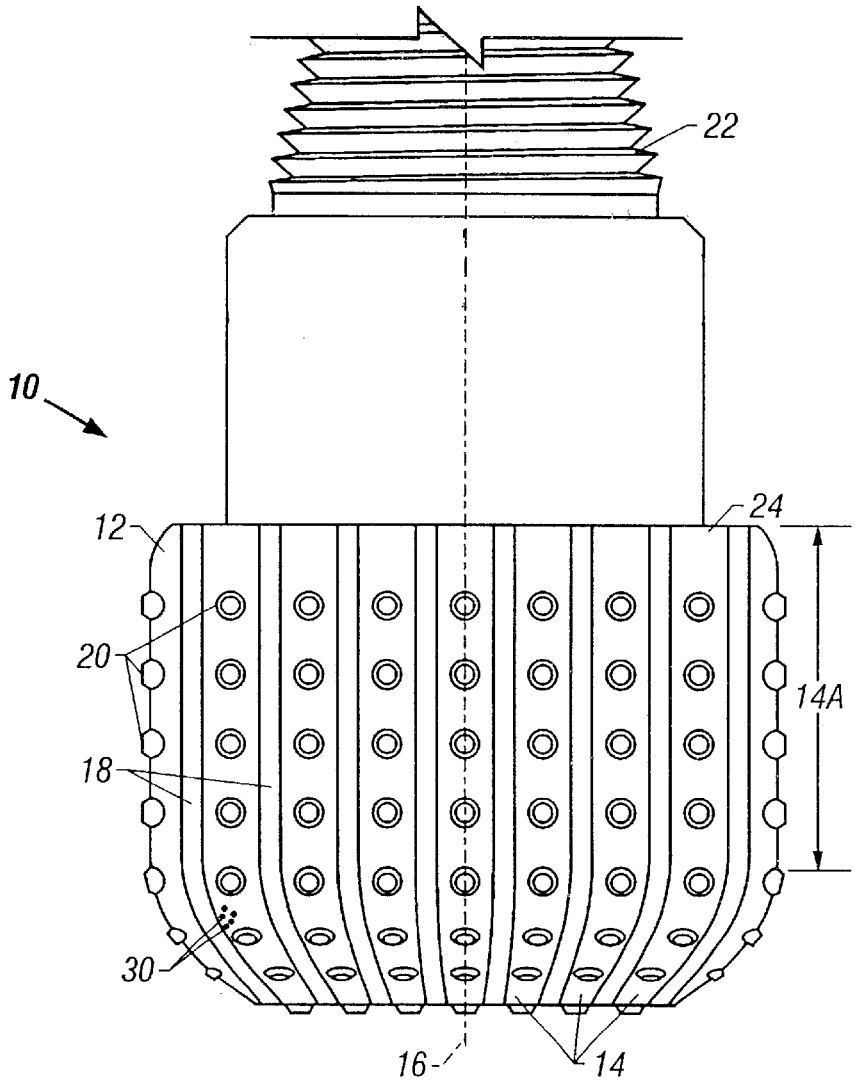
FIG. 3 shows a side view of an embodiment of the invention where the asymmetry of the bit has been exaggerated.
Figure 7:
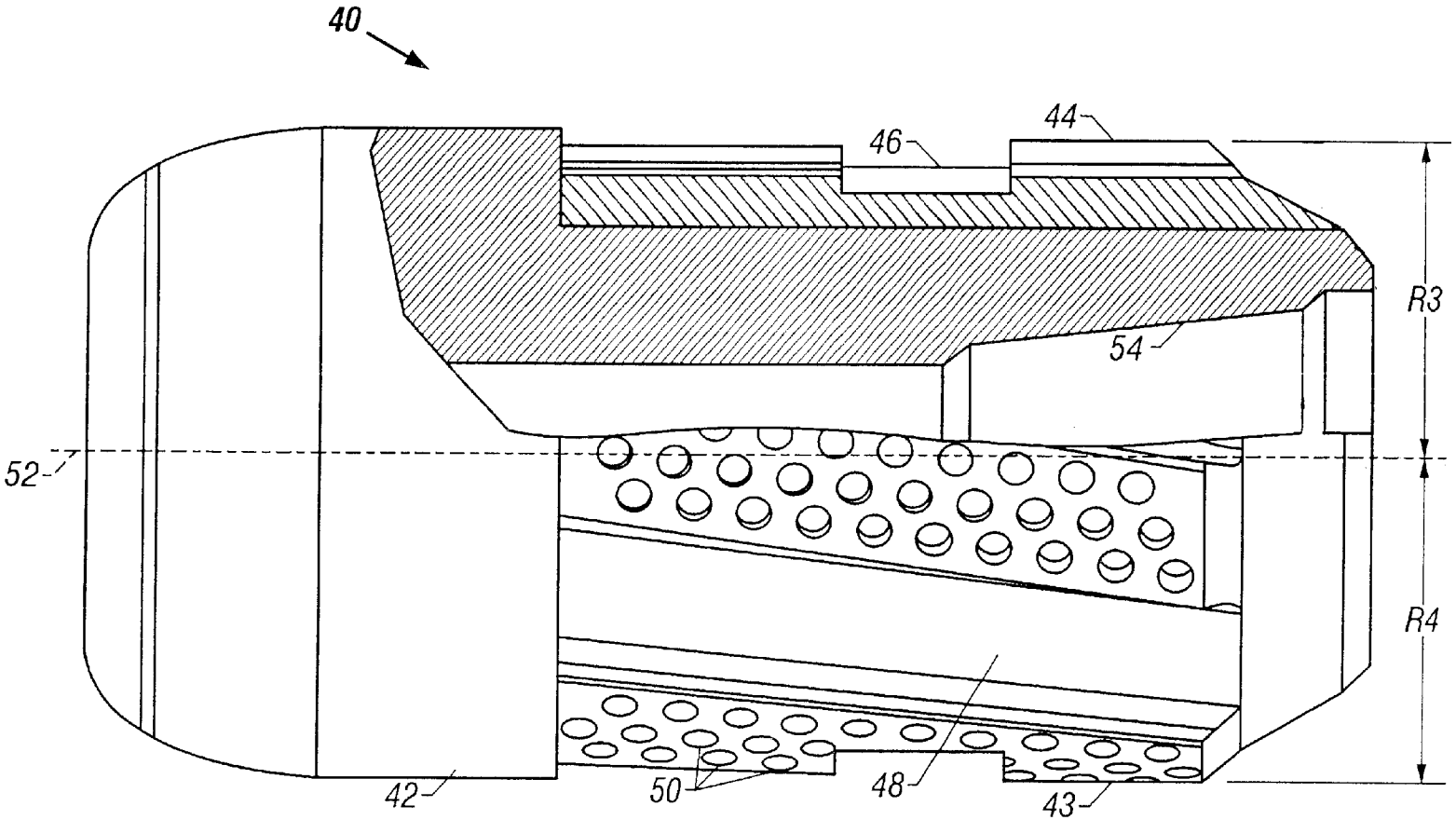
FIG. 7 shows a side view of an embodiment of the invention including a gage sleeve.

One embodiment of the invention, as shown in FIG. 3, is a drill bit 10 including a substantially cylindrical bit body 12, which defines an axis of rotation 16. The shape of the bit with respect to the axis 16 will be further explained. The drill bit 10 includes a tapered, threaded connection 22 that may join the bit 10 to a bottom hole assembly ("BHA"—not shown in FIG. 1) used to drill a wellbore (not shown in FIG. 1). The threaded connection 22 is well known in the art and may differ in appearance from the embodiment shown in FIG. 3. The connection 22 may also be a box connection (as shown in FIG. 7).

The bit 10 in this embodiment includes a plurality of channels 18 that are formed or milled into the bit surface 24 during manufacturing. The channels 18 provide fluid passages for the flow of drilling fluids into and out of the wellbore. The flow of drilling fluids, as is well known in the art, assists in the removal of cuttings from the wellbore and help reduce the high temperatures experienced when drilling a wellbore. Drilling fluid may be provided to the wellbore through nozzles (not shown) disposed proximate the channels 18, although typical impregnated bits such as the embodiment shown in FIG. 3 typically include an area referred to as a "crows foot" (not shown separately in FIG. 3) where the drilling fluid passes from inside the bit to the bit surface. Nozzles (not shown), if used in any embodiment of a bit made according to the invention, may also be disposed on other portions of the bit 10.

The channels 18 that cross the surface 24 of the bit body 12 define a plurality of blades 14. The blades 14 may be of any shape known in the art, such as helically formed with respect to the axis 16, or straight (substantially parallel to the axis 16). In the embodiment shown in FIG. 3, the blades 14 are straight, and define a substantially right-cylindrical surface, meaning that the defined surface is substantially parallel to the axis 16. However, this aspect of the blade shape is not meant to limit the invention. For example, the blades 14 may alternatively define a surface having a diameter substantially less than a drill diameter proximate a lower surface of the bit 10 and taper, defining a gradually increasing diameter, to the full drill diameter at a selected axial position along the bit 10. The blades 14 may also taper axially in the opposite manner. An important aspect of a bit made according to the invention is the drill diameter defined by the blades. The defined drill diameter will be further explained.

The bit 10 and the blades 14 are manufactured from a base matrix material. The bit 10 is typically formed through a powder metallurgy process in which abrasive particles 30 are added to the base matrix material to form an impregnated bit 10. While FIG. 3 shows an example of the abrasive particles 30 located on a limited region of the bit surface 24, the abrasive particles 30 are typically located throughout the surface 24 of the drill bit 10. The bit 10 may also include abrasive inserts, shown generally at 20, disposed generally in the surface of the blades 14. The inserts 20 include abrasive particles, which may be synthetic or natural diamond, boron nitride, or any other hard or superhard material.

Figure 4:
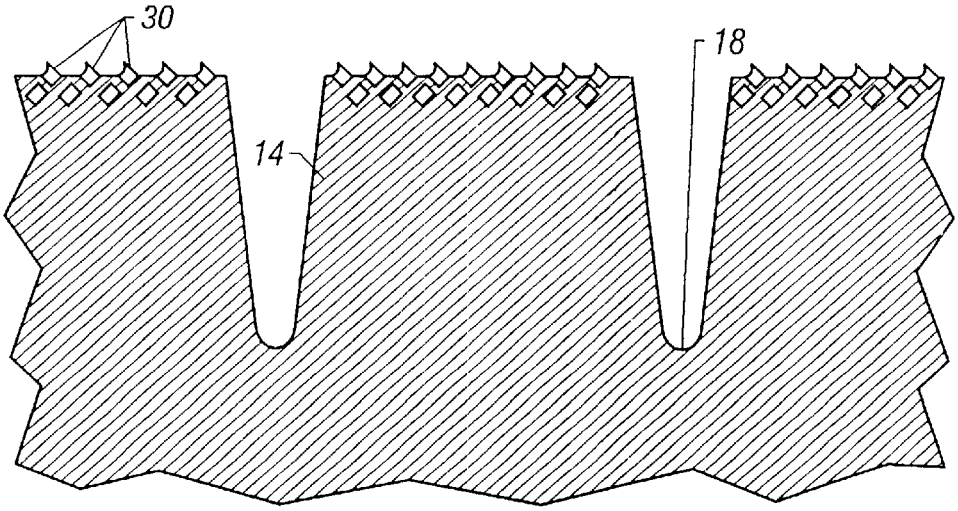
FIG. 4 shows a view of the abrasive particle impregnation of the surface of an embodiment of the invention.

FIG. 4 shows the abrasive particles 30 located at and beneath the surface of one of the blades 14. Preferably the abrasive particles 30 are present throughout the entire thickness of the blades 14. The abrasive particles 30 are typically made from synthetic diamond, natural diamond, boron nitride, or other superhard material. The abrasive particles 30 can effectively drill a hole in very hard or abrasive formations and tolerate high rotational speeds. The abrasive particles 30 disposed at and below the surface of the blades 14 are advantageous because, unlike surface mounted cutters, the abrasive particles 30 are embedded in the matrix surface 24 of the bit 10. The abrasive particles 30 are durable and are less likely to exhibit premature wear than surface set cutters. For example, the embedded abrasive particles 30 are less likely to be sheared off or "popped out" of the bit 10 than are comparable surface set cutters. Even as the particles 30 drop off as the blades 14 wear, new particles 30 will be continually exposed because they are preferably disposed throughout the thickness of the blades 14, maintaining the cutting ability of the blades 14. The abrasive particles 30 in this embodiment comprise a size range of approximately 250–300 stones per carat (while comparable surface set diamonds comprise a size range of approximately 2–6 stones per carat). However, in other embodiments, larger abrasive particles may also be used, for example in a size range of 4–5 stones per carat. Accordingly, the abrasive particle 30 size is not meant to limit the invention.

The bit 10 as shown in FIG. 3 rotates about the bit axis of rotation 16 during drilling operations. When rotated about the axis 16, the bit drills a hole having the drill diameter. However, the pass through diameter of the bit 10 is smaller than the drill diameter because of the preferred shape of the blades 14. The construction of the bit 10 is better illustrated in FIGS. 5 and 6. The axis 16 is substantially coaxial with the bit body 12 and with the threaded connection 22. The drill diameter of the bit D1 is defined by twice a larger radius of curvature R1 of the blades disposed on one side 33 of the bit. During manufacture, for example, the bit 10 can be machined so that the laterally outermost surface of the blades 14 disposed on the one side 33 substantially conform to the larger radius R1. However, the other side 32 of the bit is formed so that the laterally outermost surface of the blades 14 thereon conform to a smaller radius R2. Diameter D2, which is the sum of radii R1 and R2 and is smaller than twice R1, is equal to the pass through diameter of the bit 10. The pass through diameter D2, as previously explained, is the smallest diameter opening through which the bit may freely pass. Therefore, a bit made according to the invention may be passed through a wellbore or casing with a pass through diameter D2, and then drill out formations below the casing or at a selected depth at the full drill diameter D1.

In one embodiment of the bit according to the invention, the blades 14 may extend, at least on the side of the bit where they conform to the full extent of the larger radius, along a substantial axial length in the direction of the threaded connection (22 in FIG. 3). The portion of the blades 14 which conform to the full extent of their respective radii is shown in FIG. 3 at 14A. This portion of the blades is known as the gage portion. This feature of extended axial length of the gage portion 14A is known as "extended gage". The extended gage is preferably included on the blades 14 on both sides (33, 32 in FIG. 6) of the bit, but at least the extended gage should be on the blades on the side (33 in FIG. 6) which conforms to the full drill radius (R1 in FIG. 6). The gage portion of the blades 14, if used in any bit according to the invention, may or may not include abrasive particles (30 in FIG. 3) in the structure of that portion of the blades 14. Preferably, the axial length of the extended gage portion is at least 60 percent of the drill diameter D1.

In some embodiments of the bit according to the invention, the gage portion of at least one of the blades 14, and preferably all of the blades 14 includes the abrasive particles 30 impregnated therein to improve the gage protection of a bit according to the invention. Other embodiments may include only the inserts for gage protection, having the particles in the blades only on the lower (cutting) end of the bit.

Figure 5:
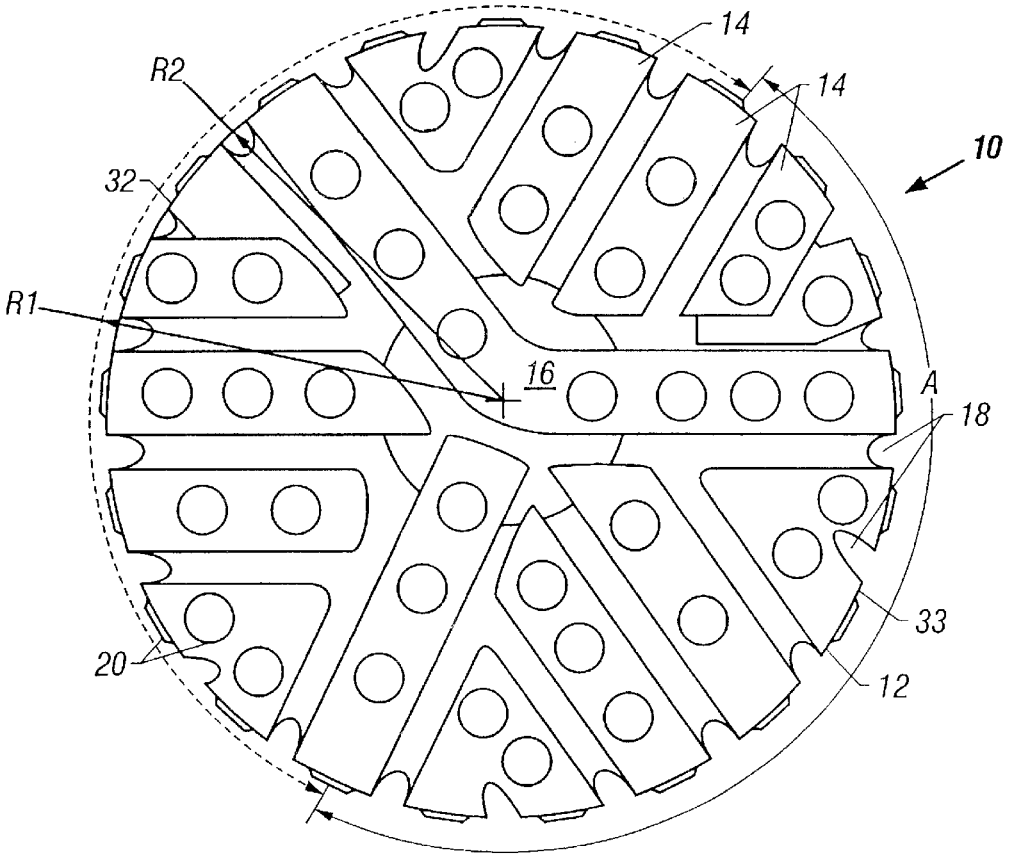
FIG. 5 shows a bottom view of an embodiment of the invention.
Figure 6:
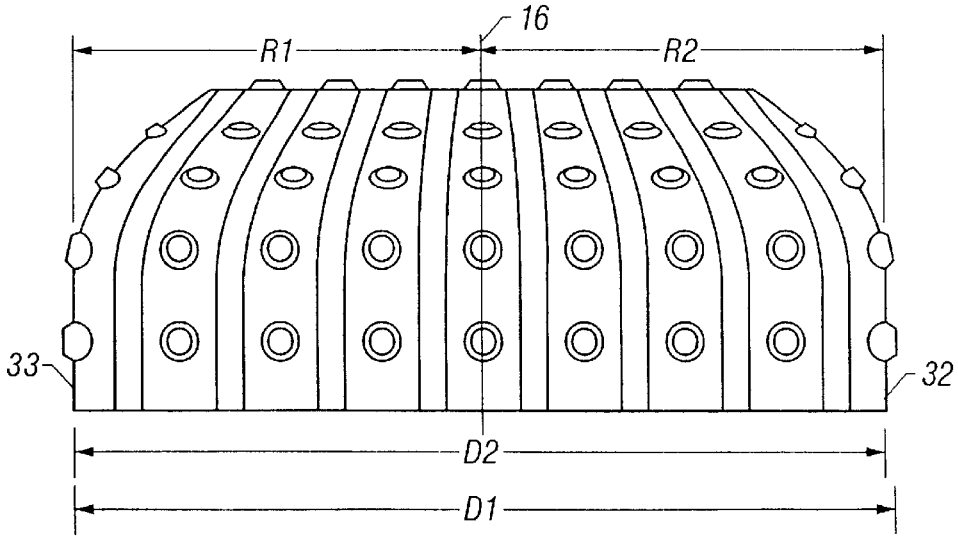
FIG. 6 shows a side view of an embodiment of the invention including an illustration of the drill diameter and the pass through diameter.

The appearance that smaller radius R2 is smaller than larger radius R1 is exaggerated in FIGS. 5 and 6 to clarify the explanation of the invention. The smaller radius R2 may be substantially different than what is shown in FIGS. 5 and 6 in any particular bit made according to this aspect of the invention. The smaller radius R2, in combination with the larger radius R1, defines asymmetry of a bit according to the invention.

The asymmetry of the bit 10 does not materially adversely affect bit stability during drilling. Other embodiments of the invention further improve stability as compared to prior art bits. For example, one particular embodiment of the bit 10 is mass balanced such that the center of mass of the bit 10 is located within 1 percent of the drill diameter D1 from the axis of rotation 16. More preferably, the bit 10 is mass balanced so that the center of mass is located within 0.1 percent of the drill diameter D1. Mass balancing may be achieved through several methods. For example, the width and depth of the channels 18 may be varied or modified to achieve the desired mass balance. Other methods of balancing are known in the art. The more balanced embodiments of the bit 10 stay better centered in the wellbore while drilling, and have less tendency to deviate from any selected wellbore trajectory during drilling. Furthermore, because the asymmetry is not formed by offsetting the bit axis of rotation or the threaded connection as in some prior art bits, the bit according to the invention does not experience instability from rotating about an axis other than a centerline of the bit body.

Another aspect of the invention is a preferred range of a contact angle A (shown in FIG. 5) of the bit 10 with the formation (not shown) being drilled. The contact angle A ultimately defines the contact area between the blades on the side 33 of the bit defining the larger radius (Ri in FIG. 6) and correspondingly the drill diameter (D1 in FIG. 6). Preferably, the contact angle A according to this aspect of the invention should be as large as possible, to make blade contact with the formations being drilled over as large an area as possible. The contact angle A in this aspect of the invention is typically about 140 to 180 degrees. Specifically, in one embodiment, the contact angle A is about 140 to 160 degrees. In another embodiment of a bit according to this aspect of the invention, the contact angle A is about 160 to 180 degrees. These are generally larger contact angles than used in prior art asymmetric bits. The large contact angle A enables the bit 10 according to the invention to more efficiently drill a gage wellbore and can reduce wear on the bit because of a larger drill area.

Another embodiment of a bit 40 according to the invention is shown in FIG. 7 and includes a bit body 42 and a gage sleeve 43. The bit body 42 shown in FIG. 7 has not yet been finished to include channels, blades, gage protection elements, etc. for clarity of the illustration. However, on being finished, the bit body 42 can be formed to create a bit according to any embodiment of the bit described previously herein. The bit body 42 in this aspect of the invention may also be finish formed into a symmetric impregnated bit as known in the prior art. The bit body 42 can be attached to the gage sleeve 43 by any suitable means known in the art.

The gage sleeve 43 in this embodiment includes blades 44, grooves 48, and slots 46. The slots 46 are included to enable the bit 40 to be connected to a BHA (not shown) wherein the slots 46 provide gripping spaces for rig tongs (not shown) used to make up the sleeve 43 to the BHA (not shown) in a manner well known in the art. The grooves 48 provide pathways for drilling fluid circulation. The blades 44 in this embodiment include a plurality of gage protection elements 50. The gage protection elements 50 protect the gage sleeve 43 from excessive wear. In one embodiment, the gage sleeve 43 may include a box (female) connection, as shown at 54, for threaded coupling to the BHA (not shown).

The gage sleeve 43 serves to further stabilize the bit 40 in the wellbore during drilling. The gage sleeve 43 may have blades 44 which are symmetric with respect to the axis 52, or may be asymmetric in a manner similar to the bit body 42 when the bit body 42 is formed according to previous embodiments of the invention. For example, the embodiment of the gage sleeve 43 shown in FIG. 7 may be formed so that the blades 46 conform to two different radii R3 and R4. In one embodiment, the blades 46 are formed on one side of the sleeve 43 so that radius R4 defined by these blades is smaller than radius R3 defined by the blades 46 on the other side of the sleeve 43. The smaller radius R4 of the gage sleeve 43 is preferably azimuthally aligned with the smaller radius (not shown) of the bit body 42 when the bit body is made according to previous embodiments of the invention.

The pass through diameter of the gage sleeve 43 thus formed, which is the sum of radii R3 and R4, may be substantially the same diameter as the pass through diameter (D2 in FIG. 6) of the bit body 42. The gage sleeve 43 may also have a smaller pass through diameter than the pass through diameter D2 of the bit. In either configuration, the gage sleeve 43 serves to stabilize the bit and 40 to help maintain the selected drilling trajectory.

Figure 8:
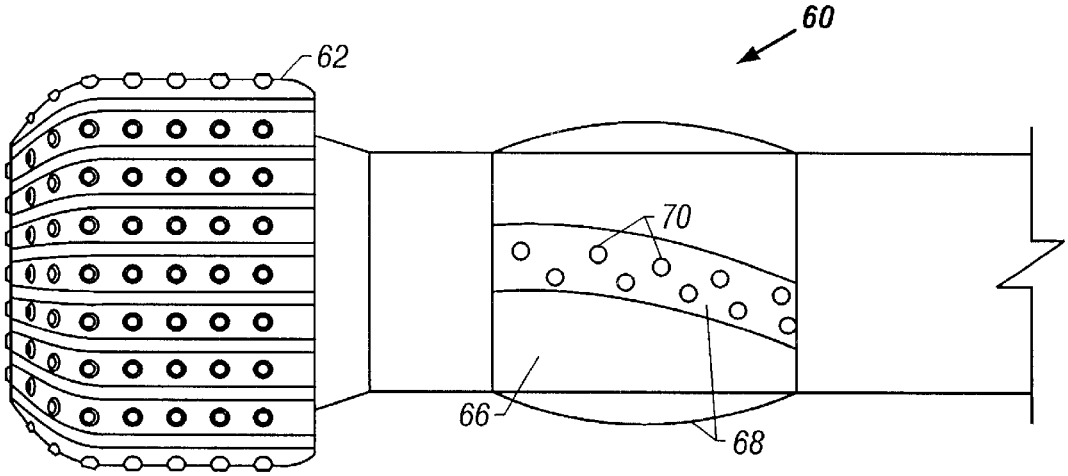
FIG. 8 shows a side view of an embodiment of the invention including a stabilizer.

Another embodiment of the invention is shown in FIG. 8. An asymmetric bit 62, as described in previous embodiments, is shown with a stabilizer 64 located axially above the bit 62 on a bottom hole assembly 60. The stabilizer 64 serves to further centralize the bit 62 in a wellbore. The stabilizer 64 may be asymmetric or symmetric. Asymmetry, when the stabilizer is so formed, is provided in the same manner as previously described for the gage sleeve (43 in FIG. 7). If the stabilizer 64 is asymmetric, the side of the stabilizer which defines the smaller radius is preferably azimuthally aligned with the side of the bit 62 which defines the smaller radius. However, the smaller radius side of the stabilizer 64 may be azimuthally positioned at any azimuthal position relative to the smaller radius side of the bit 62. Moreover, the stabilizer 64 may have a gage diameter (defined as twice the larger radius) which is substantially the same as the pass through diameter of the asymmetric bit 62. The stabilizer 64 may also have a gage diameter smaller than the pass through diameter of the asymmetric bit 62.

The stabilizer 64 may include channels 66 and blades 68 similar to the channels and blades of the gage sleeve (43 in FIG. 6) of the previous embodiment. The blades 68 and channels 66 may be tapered, helically formed, or straight. The blades 68 may be provided with inserts 70 that protect the stabilizer 64 from excessive wear. The blades 68 may also be surfaced with a wear resistant coating of any type well known in the art.

Referring once again to FIG. 3, the threaded connection is shown as a "pin" (male threaded connection). In another embodiment, the threaded connection is a "box" (female threaded connection).

The invention presents a solution to increasing the life and efficiency of diamond impregnated drill bits. Because the asymmetry of the bit is formed by forming one side of the bit to define a smaller radius, the stability of the bit is not compromised. This configuration has advantages over prior art bits that drill a hole larger than the pass through diameter of the bit by offsetting the axis of rotation or the threaded connection. Offsetting the axis or the threaded connection may adversely affect the stability of the bit or reduce the size and strength of the threaded connection.

Moreover, by providing a larger contact angle between the asymmetric side of the bit and the formation, the bit according to the invention can be more efficient than prior art bits bit. The larger contact surface can be especially useful when drilling very hard and abrasive formations.

While the invention has been described with respect to a limited number of embodiments, those skilled in the art will appreciate that other embodiments of the invention can be devised which do not depart from the spirit and scope of the invention. Accordingly, the invention shall be limited in scope only by the attached claims.

What is claimed is:

1. A drill bit comprising:

a plurality of blades formed in the bit body at least in part from solid infiltrated matrix material, the blades being impregnated with a plurality of abrasive particles, the blades being distributed around substantially the entire circumference of the bit body, wherein, with respect to an axis of rotation of the bit, the radius of curvature of one side of the bit differs from the radius of curvature of an opposite side of the bit so that the bit drills a larger diameter hole than a pass through diameter of the bit at least some of the blades on the one side including the abrasive particles therein.

2. The bit of claim 1, wherein abrasive inserts are disposed on at least one of the blades.

3. The bit of claim 2, wherein the inserts are arranged about the full circumference of the bit.

4. The bit of claim 2, wherein the inserts comprise synthetic diamond.

5. The bit of claim 2, wherein the inserts comprise natural diamond.

6. The bit of claim 2, wherein the inserts comprise boron nitride.

7. The bit of claim 1, wherein a contact angle subtended by the opposite side is at least 140 degrees.

8. The bit of claim 1, wherein a contact angle subtended by the opposite side is between 140 degrees and 160 degrees.

9. The bit of claim 1, wherein a contact angle subtended by the opposite side is between 160 degrees and 180 degrees.

10. The bit of claim 1, wherein the abrasive particles comprise synthetic diamond.

11. The bit of claim 1, wherein the abrasive particles comprise natural diamond.

12. The bit of claim 1, wherein the abrasive particles comprise boron nitride.

13. The bit of claim 1, wherein the bit is mass balanced so that a bit center of mass is within 1 percent of a drill diameter from a bit axis of rotation.

14. The bit of claim 1, wherein the bit is mass balanced so that a bit center of mass is within 0.1 percent of a drill diameter from a bit axis of rotation.

15. The bit of claim 1, wherein a stabilizer is positioned axially above the bit in a bottom hole assembly.

16. The bit of claim 15, wherein, with respect to the axis of rotation, the stabilizer includes one side formed to a radius smaller than an opposite side of the stabilizer.

17. The bit of claim 15, wherein the stabilizer has a diameter that is less than the pass through diameter of the bit.

18. The bit of claim 15, wherein the stabilizer has a diameter that is substantially equal to the pass through diameter of the bit.

19. The bit of claim 15, wherein the stabilizer further comprises:

a plurality of blades; and a plurality of inserts disposed on the stabilizer blades.

20. The bit of claim 19, wherein the inserts on the stabilizer comprise synthetic diamond.

21. The bit of claim 19, wherein the inserts on the stabilizer comprise natural diamond.

22. The bit of claim 19, wherein the inserts on the stabilizer comprise boron nitride.

23. The bit of claim 1 further comprising a box connection formed in a connection end of the body.

24. The drill bit as defined in claim 1 wherein the blades on at least the opposite side of the bit comprise an axial length where the blades are formed to the respective one of the radii of at least 60 percent of the diameter of a hole drilled by the bit.

25. The drill bit as defined in claim 1 wherein the abrasive particles impregnate a gage portion of at least one of the blades to improve gage protection thereof.

26. A drill bit comprising:

a bit body, a plurality of blades formed in the bit body at least in part from solid infiltrated matrix material, the blades having abrasive particles thereon, the blades being distributed around substantially the entire circumference of the bit body, the blades formed so that, with respect to an axis of rotation of the bit, the radius of curvature of one side of the bit differs from the radius of curvature of an opposite side of the bit so that the bit drills a larger diameter hole than a pass through diameter of the bit at least part of the one side of the bit including abrasive particles therein; and a gage sleeve attached to the bit body at a connection end of the bit body.

27. The bit of claim 26, wherein, with respect to the axis of rotation, the gage sleeve includes one side that is formed to a smaller radius than an opposite side of the gage sleeve.

28. The bit of claim 26, wherein the gage sleeve is positioned such that a smaller radius side of the gage sleeve and the smaller radius side of the bit are substantially azimuthally aligned.

29. The bit of claim 26, wherein the gage sleeve is removably attached to the bit body.

30. The bit of claim 26, wherein the abrasive particles comprise synthetic diamond.

31. The bit of claim 26 wherein the abrasive particles comprise natural diamond.

32. The bit of claim 26 wherein the abrasive particles comprise boron nitride.

33. The bit of claim 26 wherein the gage sleeve has a diameter that is substantially equal to the pass through diameter of the bit.

34. The bit of claim 26, wherein the gage sleeve has a diameter that is less than the pass through diameter of the bit.

35. The bit of claim 26, wherein the bit and the gage sleeve are mass balanced so that a center of mass of the bit and the gage sleeve are located within 1 percent of a drill diameter of the bit from the axis of rotation.

36. The bit of claim 26, wherein the bit and the gage sleeve are mass balanced so that a center of mass of the bit and the gage sleeve are located within 0.1 percent of a drill diameter of the bit from the axis of rotation.

37. The bit of claim 26, wherein the gage sleeve further comprises a plurality of gage protection inserts disposed on the blades thereof.

38. The bit of claim 37, wherein the inserts on the gage sleeve comprise synthetic diamond.

39. The bit of claim 37, wherein the inserts on the gage sleeve comprise natural diamond.

40. The bit of claim 37, wherein the inserts on the gage sleeve comprise boron nitride.

41. The bit of claim 26 wherein the gage sleeve comprises a box connection on an end thereof opposite the connection end of the bit body.

42. The bit of claim 26 wherein the abrasive particles are disposed on a gage portion of at least one of the blades to improve gage protection thereof.

43. The bit of claim 26 wherein the abrasive particles comprise particles impregnated into the blades.

44. A drill bit comprising:

a bit body, and a plurality of blades formed in the bit body at least in part from solid infiltrated matrix material, the blades having abrasive particles thereon, the blades being distributed around substantially the entire circumference of the bit body, the blades formed so that, with respect to an axis of rotation of the bit, the radius of curvature of one side of the bit differs from the radius of curvature of an opposite side of the bit so that the bit drills a larger diameter hole than a pass through diameter of the bit, at least some of the blades on the one side including abrasive particles therein, the blades on at least the opposite side comprise an axial length where the blades are formed to the respective one of the radii of at least 60 percent of the diameter of a hole drilled by the bit.

45. The drill bit of claim 44 wherein the extended axial length is at least 60 percent of a drill diameter of the bit on the one side of the bit.

46. The drill bit of claim 44 wherein the abrasive particles comprise particles impregnated into the blades.

47. The drill bit of claim 44 wherein the abrasive particles comprise at least one selected from natural diamond, synthetic diamond and boron nitride.

48. The drill bit of claim 44 further comprising a gage sleeve coupled to a connection end of the bit body.

49. The bit of claim 48, wherein, with respect to the axis of rotation, the gage sleeve includes one side that is formed to a smaller radius than an opposite side of the gage sleeve.

50. The bit of claim 48, wherein the gage sleeve is positioned such that a smaller radius side of the gage sleeve and the smaller radius side of the bit are substantially azimuthally aligned.

51. The bit of claim 48, wherein the gage sleeve is removably attached to the bit body.

52. The bit of claim 44 further comprising at least one gage protection insert on a gage portion of at least one of the blades.

53. A drill bit comprising:

a bit body, and a plurality of blades formed in the bit body at least in part from solid infiltrated matrix material, the blades having abrasive particles thereon, the blades being distributed around substantially the entire circumference of the bit body, the blades formed so that, with respect to an axis of rotation of the bit, one side of the bit is formed to a smaller radius than an opposite side of the bit so that the bit drills a larger diameter hole than a pass through diameter of the bit, at least some of the blades on the one side including abrasive particles therein, the blades the opposite side of the bit defining a contact angle of at least 140 degrees.

54. The drill bit as defined claim 53 wherein the contact angle is between 140 and 160 degrees.

55. The drill bit as defined in claim 53 wherein the contact angle is at least 160 degrees.

56. The drill bit as defined in claim 53 wherein the blades on at least the opposite side of the bit comprise an axial length where the blades are formed to the respective one of the radii of at least 60 percent of the diameter of a hole drilled by the bit.

57. The drill bit as defined in claim 53 wherein the extended axial length is at least 60 percent of a drill diameter of the bit on the one side of the bit.

58. The drill bit as defined in claim 53 wherein the abrasive particles comprise particles impregnated into the blades.

59. The drill bit as defined in claim 53 wherein the abrasive particles comprise at least on e selected from natural diamond, synthetic diamond and boron nitride.

60. The drill bit of claim 53 further comprising a gage sleeve coupled to a connection end of the bit body.

61. The bit of claim 60, wherein, with respect to the axis of rotation, the gage sleeve includes one side that is formed to a smaller radius than an opposite side of the gage sleeve.

62. The bit of claim 60, wherein the gage sleeve is positioned relative to the bit body such that a smaller radius side of the gage sleeve and the smaller radius side of the bit are substantially azimuthally aligned.

63. The bit of claim 53 further comprising at least one gage protection insert disposed on a gage section of at least one of the blades.

* * * * *